US005932336A

United States Patent [19]

Allen et al.

[11] Patent Number: 5,932,336

[45] Date of Patent: Aug. 3, 1999

[54] SHOE SOLE

[75] Inventors: Bernie Allen, Wayland, Mass.; Zoran Petrovic, Pittsburg, Kans.

[73] Assignee: Acushnet Company, Fairhaven, Mass.

[21] Appl. No.: 08/839,819

[22] Filed: Apr. 18, 1997

Related U.S. Application Data

[62] Division of application No. 08/462,310, Jun. 5, 1995.

[51] Int. Cl.[6] ..... B32B 5/18; B32B 5/28; A43B 13/12

[52] U.S. Cl. ..... 428/315.5; 428/138; 428/221; 428/308.4; 428/313.5; 428/423.1; 428/423.3; 36/28; 36/29; 36/30 A; 36/32 R; 521/59; 521/60; 521/137

[58] Field of Search ..... 521/59, 60, 137; 428/221, 423.1, 423.3, 138, 308.4, 313.5, 315.5; 36/28, 29, 30 A, 32 R

[56] References Cited

U.S. PATENT DOCUMENTS

| | | | |
|---|---|---|---|
| 2,315,874 | 4/1943 | Sabel et al. | 361/127 |
| 2,416,526 | 2/1947 | Koenig | 36/127 |
| 2,745,197 | 5/1956 | Holt | 36/2.5 |
| 3,010,229 | 11/1961 | Snitzer | 36/127 |
| 3,066,425 | 12/1962 | Koley | 36/2.5 |
| 3,218,734 | 11/1965 | O'Brien | 36/2.5 |
| 3,267,593 | 8/1966 | Turner | 36/59 |
| 3,328,901 | 7/1967 | Strickland | 36/127 X |
| 3,333,352 | 8/1967 | Livingston | 36/2.5 |
| 3,410,005 | 11/1968 | Szerenvi | 36/127 |
| 3,492,744 | 2/1970 | Bernier et al. | 36/127 X |
| 3,583,082 | 6/1971 | Jordan, Jr. | 36/59 |
| 3,587,181 | 6/1971 | Bernier et al. | 36/2.5 |
| 3,597,863 | 8/1971 | Austin et al. | 36/2.5 |
| 3,718,996 | 3/1973 | Austin | 36/67 B |
| 3,739,499 | 6/1973 | Morin | 36/2.5 |
| 3,812,603 | 5/1974 | Goodman | 36/2.5 |
| 3,812,605 | 5/1974 | Kaestle | 36/67 |
| 3,816,945 | 6/1974 | Egtvedt | 36/2.5 |
| 3,964,180 | 6/1976 | Cortese | 36/135 |
| 4,035,934 | 7/1977 | Hrivnak | 36/67 |
| 4,107,858 | 8/1978 | Bowerman et al. | 36/134 |
| 4,179,826 | 12/1979 | Davidson | 36/69 |
| 4,240,215 | 12/1980 | Broussard | 36/67 |
| 4,314,411 | 2/1982 | Hanson | 36/91 X |
| 4,327,503 | 5/1982 | Johnson | 36/32 |
| 4,330,950 | 5/1982 | Reddien | 36/127 |
| 4,367,600 | 1/1983 | Cross, III et al. | 36/127 |
| 4,393,604 | 7/1983 | Crowley | 36/67 |
| 4,492,047 | 1/1985 | Arff | 36/134 |
| 4,506,460 | 3/1985 | Rudy | 36/28 |
| 4,523,396 | 6/1985 | Dassler | 36/134 |
| 4,524,531 | 6/1985 | VanDeripe | 36/127 |
| 4,559,724 | 12/1985 | Norton | 36/129 |
| 4,561,197 | 12/1985 | Misevich | 36/127 |
| 4,569,142 | 2/1986 | Akinasi | 36/134 |
| 4,577,422 | 3/1986 | Tanel | 36/126 |
| 4,580,359 | 4/1986 | Kurrash et al. | 36/127 |
| 4,619,055 | 10/1986 | Davidson | 36/28 |
| 4,633,600 | 1/1987 | Dassler et al. | 36/126 |
| 4,660,304 | 4/1987 | Tanel | 36/134 |
| 4,667,422 | 5/1987 | Yamaguchi | 36/67 |
| 4,706,394 | 11/1987 | Regula | 36/67 |
| 4,742,626 | 5/1988 | Tadiotto | 36/127 |
| 4,747,220 | 5/1988 | Autry et al. | 36/59 |
| 4,748,752 | 6/1988 | Tanel | 36/126 |
| 4,754,561 | 7/1988 | Dufour | 36/127 |
| 4,776,109 | 10/1988 | Sacre | 36/3 |
| 4,782,604 | 11/1988 | Wen-Shown | 36/127 |
| 4,843,735 | 7/1989 | Nakanishi | 36/28 |
| 4,858,340 | 8/1989 | Pasternak | 36/88 |
| 4,875,300 | 10/1989 | Kazz | 36/134 |
| 4,885,851 | 12/1989 | Peterson | 36/127 |
| 4,922,636 | 5/1990 | Chen | 36/127 |
| 4,984,320 | 1/1991 | Curley, Jr. et al. | 36/146 |
| 4,999,931 | 3/1991 | Vermeulen | 26/29 |
| 5,025,576 | 6/1991 | Biasiotto et al. | 36/134 |
| 5,027,532 | 7/1991 | MacNeill et al. | 36/134 |
| 5,033,211 | 7/1991 | Latraverse et al. | 36/134 |
| 5,058,292 | 10/1991 | Tanel | 36/126 |
| 5,067,256 | 11/1991 | Darby | 36/69 |
| 5,070,631 | 12/1991 | Fenton | 36/127 |
| 5,175,946 | 1/1993 | Tsai | 36/29 |
| 5,205,056 | 4/1993 | Okajima et al. | 36/131 |
| 5,259,129 | 11/1993 | Deacon et al. | 36/127 |
| 5,265,354 | 11/1993 | Aliano, Jr. | 36/127 |

FOREIGN PATENT DOCUMENTS

| | | |
|---|---|---|
| 0 346 624 A2 | 12/1989 | European Pat. Off. . |
| 0 360 202 A1 | 3/1990 | European Pat. Off. . |
| 2615075 | 11/1988 | France . |
| 3134817 A1 | 3/1983 | Germany . |
| 3242606 A1 | 8/1983 | Germany . |

OTHER PUBLICATIONS

K.R. Williams et al., "The Mechanics of Foot Action During the Golf Swing and Implications for Shoe Design", *Medicine and Science in Sports and Exercise*, vol. 15, No. 3, pp. 247–255 (1983).

S. Carlsoo, "A Kinetic Analysis of the Golf Swing", pp. 76–82.

*Primary Examiner*—Patricia A. Short
*Attorney, Agent, or Firm*—Pennie & Edmonds LLP

[57] ABSTRACT

The present invention is an improved golf shoe which incorporates a spike socket spine frame system that extends throughout the shoe sole for receiving all of the spike receptacles and is embedded in the outsole. The spine frame provides improved shoe performance and spike location and is made of a material that is stiffer than the outsole material. More particularly, the shoe sole is comprised of a spike socket spine having seventeen spike socket locations: three spike sockets in the toe section, six spike sockets in the metatarsal section, four spike sockets in the shank section and four spike sockets in the heel section, for receiving the posts of the golf spikes.

13 Claims, 10 Drawing Sheets

SHOE SOLE

This is a division of co-pending application Ser. No. 08/462,310, filed Jun. 5, 1995, now pending.

BACKGROUND OF THE INVENTION

The present invention relates to the field of golf shoes. A golfer's performance depends on the ability of the golfer's golf shoes' to provide a solid base of support. The interaction between the shoe and the ground enables the golfer to perform the body movements necessary to culminate into an ideal contact between the club head and the ball. At the same time, golf shoes should provide comfort and relief from strain to the golfer's feet.

It has been found that, during the golf swing, each foot acts in a unique manner. Therefore, it has been suggested that the left and right shoes should be constructed differently. For instance, cleat placement should be designed to optimize the shear-forces during the golf swing and the center of pressure for each foot in order to enhance the production of forces. Furthermore, it has been suggested that the traditional raised heel should be replaced by a continuous sole and heel wedge to provide a greater contact area with the ground.

It has been determined that the rear shoe should be able to rock without generating much force and provide support by having an appropriately flexible sole, while the front shoe should be most effective in the critical contact region of the swing. At contact, the front foot supports an insecure stance and a mechanical shifting of force from the medial section to the lateral edge of the shoe.

The weight transfer pattern of a golfer during the golf swing, also termed "weight shift" or "mechanics of the feet," has been looked at by a number of investigators. The weight transfer pattern is generally measured at the ground/shoe interface. The importance of the interaction has been termed as the "vital link that allows a golfer to perform the series of body movements during the swing that lead to impact with the ball."[1]

See Williams, K. R. and Cavanagh, P. R., The Mechanics of Foot Action During the Golf Swing and Implications for Shoe Design, Med. Sci. Sports Exerc., 15(3): 247–255, 1983.

Generally, golfers shift weight to the back foot during the back swing, then shift back to the front foot during the downswing. Through the hitting area, weight is primarily on the front foot and the back heel is raised off the ground. Following impact, the weight remains on the front foot.

The present invention relates to the design of golf shoes. Golf shoes have been in existence for many years now and are characterized by the golf spikes that protrude from the shoe sole to provide stability for the golfer.

The golf shoe has traditionally been comprised of a shoe upper and a shoe sole. The shoe upper is generally constructed of leather or simulated leather that is attached to a lasting board. The shoe sole has traditionally been constructed of leather for the more expensive shoes and of a synthetic leather material or polyurethane for the lower cost shoes. The shoe sole generally includes a number of spike sockets for the golf spikes.

The golf spike has generally been characterized as a sharp cone-shaped protrusion made of metal that inserts into the ground. However, U.S. Pat. No. 5,259,129 disclose a different type of spike that can replace the traditional spike. This spike is characterized as a plastic spike with a plurality of traction ribs. Small pyramid shaped protrusions are integral with the shoe sole in U.S. Pat. No. 4,885,851. These spikes are used with the traditional spikes and allegedly provide additional support for the golfer.

The golf spikes are traditionally placed into a spike socket that is built into the shoe sole. Traditionally, this socket has threads to mate with the threads on the spike posts. However, as stated above, other spikes that are integral with the shoe sole have been contemplated. Further, U.S. Pat. No. 4,523,396 discloses a plurality of differing cleats being secured to the shoe sole with the use of a shaft that penetrates the cleat bases.

Spike sockets in prior spiked shoes are traditionally metal receptacles that are positioned in a spaced-apart relation about the sole. Alternatively, sockets have been integrated into a front plate and a heel plate which plates are positioned between the various sole layers. Still further, U.S. Pat. No. 3,597,863 discloses a PVC member for receiving spike receptacles. The PVC members can be interconnected such that all of the spike receptacles for the forepart of the sole are interconnected.

Traditionally, the shoe spikes are located such that there are approximately six to eight spike locations in the fore foot area and four spike locations in the heel section. However, U.S. Pat. No. 4,885,851 discloses supplemental ground-engaging elements located along the inner side of the right foot and along the outer side of the left foot for a right handed golfer.

SUMMARY OF THE INVENTION

Broadly, the present invention is an improved golf shoe which incorporates a spike socket spine frame system that extends throughout the shoe sole for receiving all of the spike receptacles and is embedded in the outsole. The spine frame provides improved shoe performance and spike location.

The present invention is directed to a golf shoe having an improved shoe sole. More particularly, the invention is directed to a golf shoe comprising an outer sole having heel, shank, metatarsal and toe areas and being made from a first material and a frame including a plurality of spike sockets integral with the outer sole and being made of a second material that is stiffer than the first material. More particularly, the shoe sole is comprised of a spike socket spine system for receiving the posts of the golf spikes that is integral with the shoe outer sole. The spike socket spine system is comprised of a higher stiffness material than the shoe sole material such the shoe has proper stability and flexibility. Thus, the system provides proper stiffness through the spine, particularly in the cross-direction, and flexibility, particularly in the lengthwise direction. Further, the system provides a low cost shoe that is light weight.

The spike socket spine frame integrally connects each spike socket in the entire shoe. The material is preferably a TPU with carbon or glass reinforcement fibers. More particularly, the spine is a TPU with 5% to 30% by weight reinforcement fibers. The outer sole or cup sole is preferably made of TPU or a TPU/TPR mixture, wherein the TPU comprises greater than 50% by weight of the cup sole material.

In the preferred embodiment, the spine frames for the right and left shoes are mirror images of each other, but structured such that the back shoe includes more functioning spike sockets in the shoe toe and shank areas. More particularly, the front shoe has blanks or flat spikes placed in a plurality of the spike locations such that the spikes are more concentrated in the metatarsal section of the shoe sole and the back shoe has spikes placed in all the spike locations such that the spikes are more evenly distributed from the toe section through the shank section. Even more preferably, the spine frames are comprised of seventeen spike socket locations: three spike sockets in the toe section, six spike sockets in the metatarsal section, four spike sockets in the shank section and four spike sockets in the heel section. By having the spine frames for the right and left foot be mirror images, the spike locations can be optimized for both left and right handed players. However, in an alternative embodiment, the back shoe (right shoe for right handed players) has seventeen spike socket locations as indicated above and the front shoe (left shoe for right handed players) has ten to fourteen spike socket locations: zero–two spike sockets in the toe section, six spike sockets in the metatarsal section, zero–two spike sockets in the shank section and four spike sockets in the heel section.

The present invention is also directed to a golf shoe having an improved midsole material that is low cost and provides optimum cushion and stability for the golfer. More particularly, the present invention is directed to a golf shoe having a mid sole comprised of a foamed TPU/TPR blend, a foamed butadiene style rubber or a hytrel/surlyn blend. The material can be foamed with a blowing agent, but is more preferably foamed with expanded resilient microspheres. Still further, the midsole is preferably comprised of a of a TPU/TPR blend with microspheres, wherein the average microsphere diameter on the top of the midsole is greater than the average microsphere diameter on the bottom of the midsole. Yet further still, the midsole can be formed in a molding process with substantially greater side pressure than vertical pressure such that the microspheres become elliptical in shape with the greater axis in the vertical direction. This will produce a material wherein the compressibility in the vertical direction is greater than in the cross-direction, such that the shoe provides cushion in the vertical direction and is stable in the cross-direction.

In a second embodiment of the present invention, the shoe sole can be formed without a midsole or a greatly reduced midsole such that a foot bed may be placed directly above or nearly adjacent to the socket frame and cup sole to provide greater shoe stability.

In the second embodiment, the foot bed is preferably comprised of a foamed upper layer, side walls and a waffle bottom layer.

The foamed upper layer can be comprised of a polyurethane foam with hollow microspheres or a blowing agent. In another embodiment, the foamed upper layer can be a memory foam, i.e., a foam that deforms upon compression and once the pressure is released, will slowly return to its original position, comprised of a polyol, antifoam agent, catalyst and Isocyanate. The foam upper layer is preferably made with to a Shore C hardness of approximately 25.

The side walls are preferably comprised of the same foam material as the foamed upper layer, but can further include pockets of polyurethane gel to provide a highly flowable viscoelastic medium. The polyurethane gel can be provided in various hardnesses to provide proper mediums for shoe comfort, including fit and cushioning. The polyurethane gel is preferably a soft elastomer with high sol (plasticizer) fraction which can include a high molecular weight triol (MW greater than 6000) and a diisocyanate. In another embodiment of the present invention, the flowable viscoelastic gel is a butadiene style rubber which can be prepared from oil and polyisobutadiene.

The waffle bottom layer is also preferably comprised of a foam material but is formed into a waffle pattern with interconnecting bores or channels for air circulation and reduced weight. The waffle bottom layer includes openings of any shape, such as square, round, etc., and is preferably made of a material that is harder than the upper layer. Preferably, the waffle bottom layer is made with to a Shore C hardness between 30–60 and, most preferably, about 50.

Further, the bottom layer preferably includes a plurality of soft viscoelastic gel plugs or a thin perforated layer of viscoelastic gel to cover the spike sockets in the toe, metatarsal and shank areas such that the spike pressure is dissipated from the wearer. The viscoelastic gel is preferably made of the same viscoelastic materials as described above, and has a –00 hardness of approximately 40–50. Alternatively, the lasting board of the shoe upper can include a plurality of viscoelastic plugs to dissipate spike pressure.

Still further, the foot bed is preferably comprised of a heel plug with compressible ribs that form air pockets therebetween such that air can be pressed throughout the shoe foot bed. When the golfer puts weight on the shoe heel section, such as when walking, the heel plug ribs will compress to provide cushioning and the air therebetween will be pumped through the waffle bottom layer for air circulation throughout the shoe. Preferably, the heel plug is also made of a viscoelastic material, such as those described above. However, the heel plug should be harder than the foot bed upper layer. More particularly, the heel plug should have a –00 hardness of approximately 40–50.

Further the present invention is directed to improved spike locations and to the customization of the golf spikes for the individual golfer. More particularly, at least one shoe according to the present invention has greater than fifteen spike locations. This provides increased stability for the golfers back foot. The front shoe can be formed with less spike receptacles or with a plurality of blank spikes for increased mobility during the downswing. Furthermore, the shoe can be used with an improved spike system comprised of replaceable spikes with multiple protrusions thereon and having different diameters. The different diametered spikes provide for different amounts of stability and mobility for the golfer. This allows the golfer to customize the shoe for the preferred stability.

The present invention is also direct to an improved method of forming a shoe. The method comprises the steps of injection molding a shoe spine for receiving spike posts in a first mold, placing the spine into a second mold and injection molding a cup sole about the spine with a fixed top plate, injection molding a midsole in the second mold with a spring loaded top plate, and securing a shoe upper to the midsole.

The present invention is also direct to a second improved method of forming a shoe. The method comprises the steps of injection molding a shoe spine for receiving spike posts in a first mold, placing the spine into a second mold and injection molding a cup sole about the spine with a fixed top plate, securing a shoe upper having a California last to the cup sole and inserting a foot bed into the shoe upper.

DESCRIPTION OF THE PREFERRED EMBODIMENT

Figure 1:
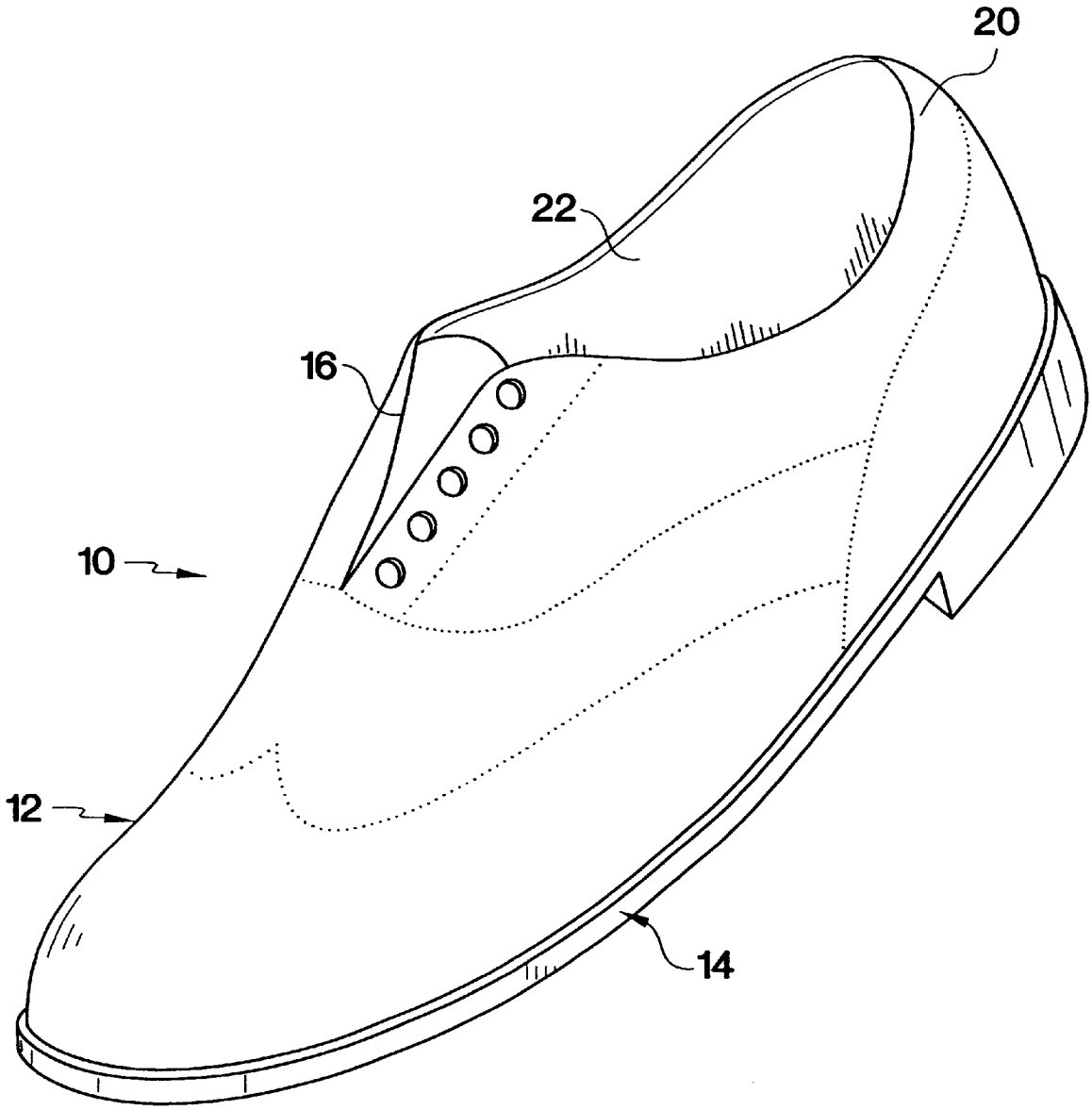
FIG. 1 is a perspective view of a golf shoe of the present invention.

Referring to FIG. 1, the present invention is directed to a golf shoe 10. The shoe is comprised of an upper 12, a sole 14 and a tongue 16. The shoe upper 12 is comprised of an outer layer 20 and an inner layer 22. In the preferred embodiment, the outer and inner layers 20 and 22 are made of leather, but substitute materials such as brush nylon can be used. The shoe upper 12 can include various gels and foams for comfort and fit such as those disclosed in applicant' copending U.S. patent application Ser. No. 08/404, 675, which is incorporated herein by reference.

Figure 2:
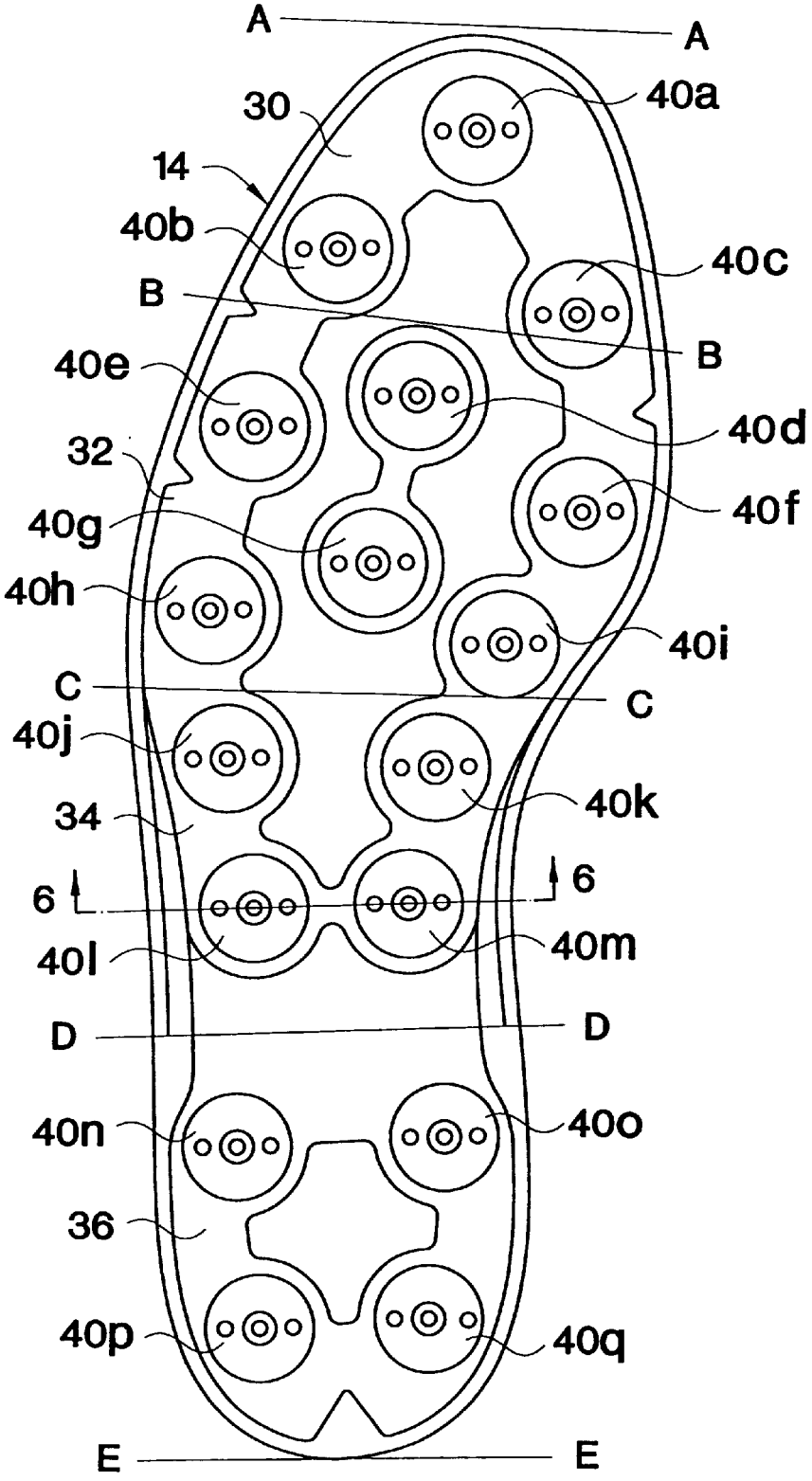
FIG. 2 is a bottom view of the golf shoe of the present invention including installed spikes.
Figure 3:
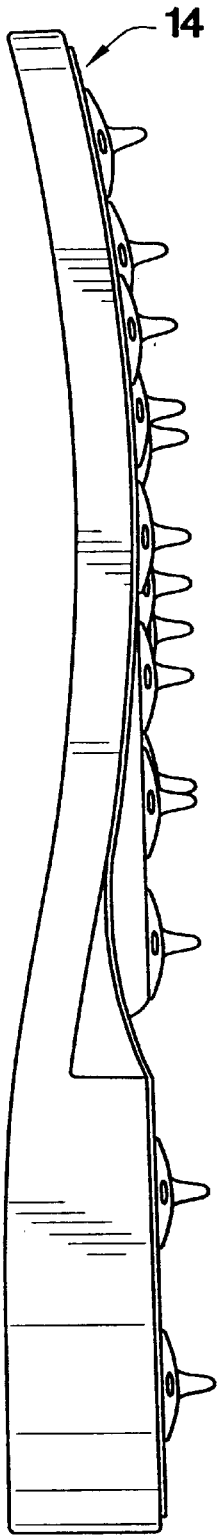
FIG. 3 is a side view of the shoe sole of the present invention including installed spikes.

Turning to FIGS. 2–3, the preferred sole 14 of the shoe 10 can be divided into four sections: the toe section 30, the metatarsal section 32, the shank section 34 and the heel section 36. The toe section 30 is defined as the section of the sole that underlies the toes of the foot and is depicted as the section between lines AA and BB. The metatarsal section 32 is defined as the section of the sole that underlies the metatarsal pad of the foot and is depicted as the section between lines BB and CC. The shank section 34 is defined as the section of the sole that underlies the arch of the foot and is depicted as the section between lines CC and DD. The heel section 36 is defined as the section of the sole that underlies the heel of the foot and is depicted as the section between lines DD and EE.

Figure 12:
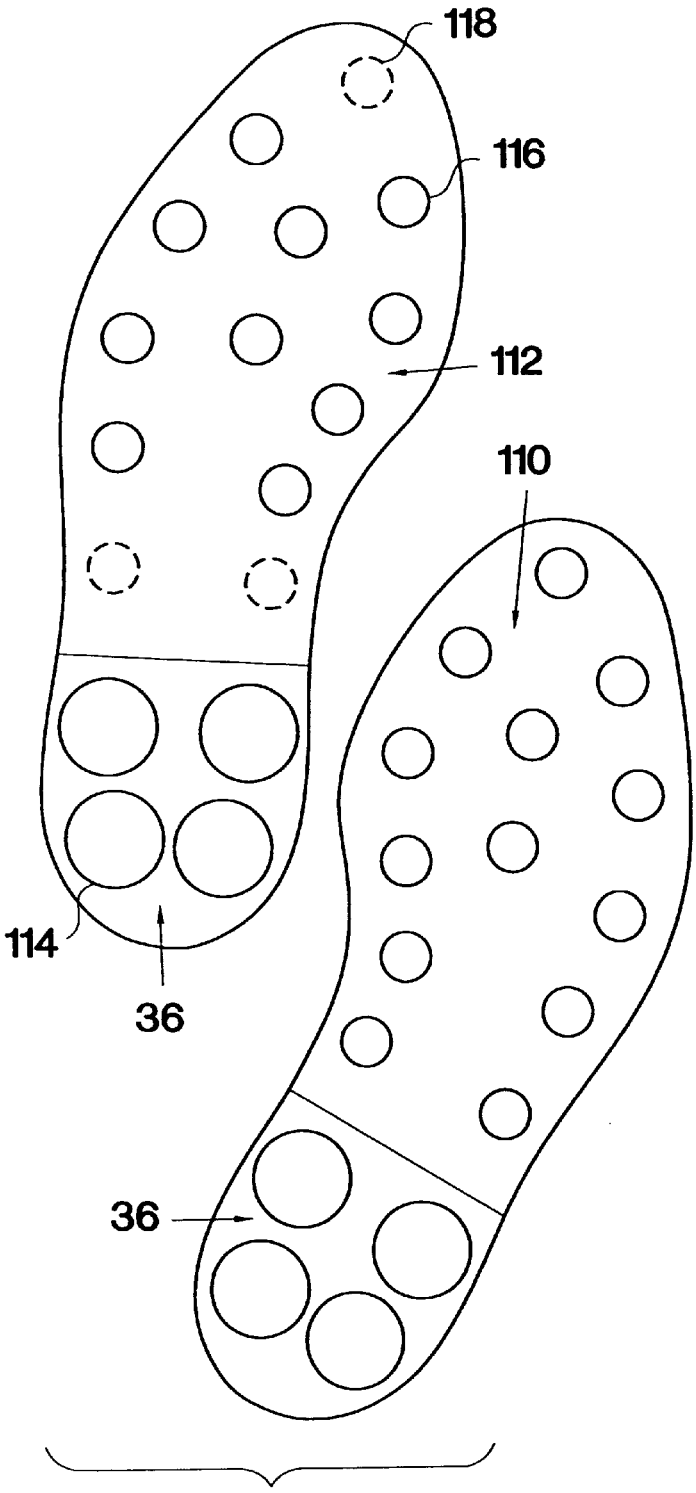
FIG. 12 is a first embodiment of a shoe incorporating different diameter replaceable spikes.
Figure 12A:
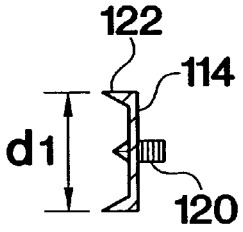
FIG. 12A is a cross-section of a first spike shown in FIG. 12.
Figure 12B:
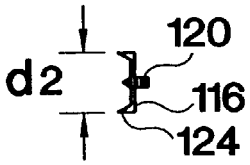
FIG. 12B is a cross-section of a second spike shown in FIG. 12.
Figure 13:
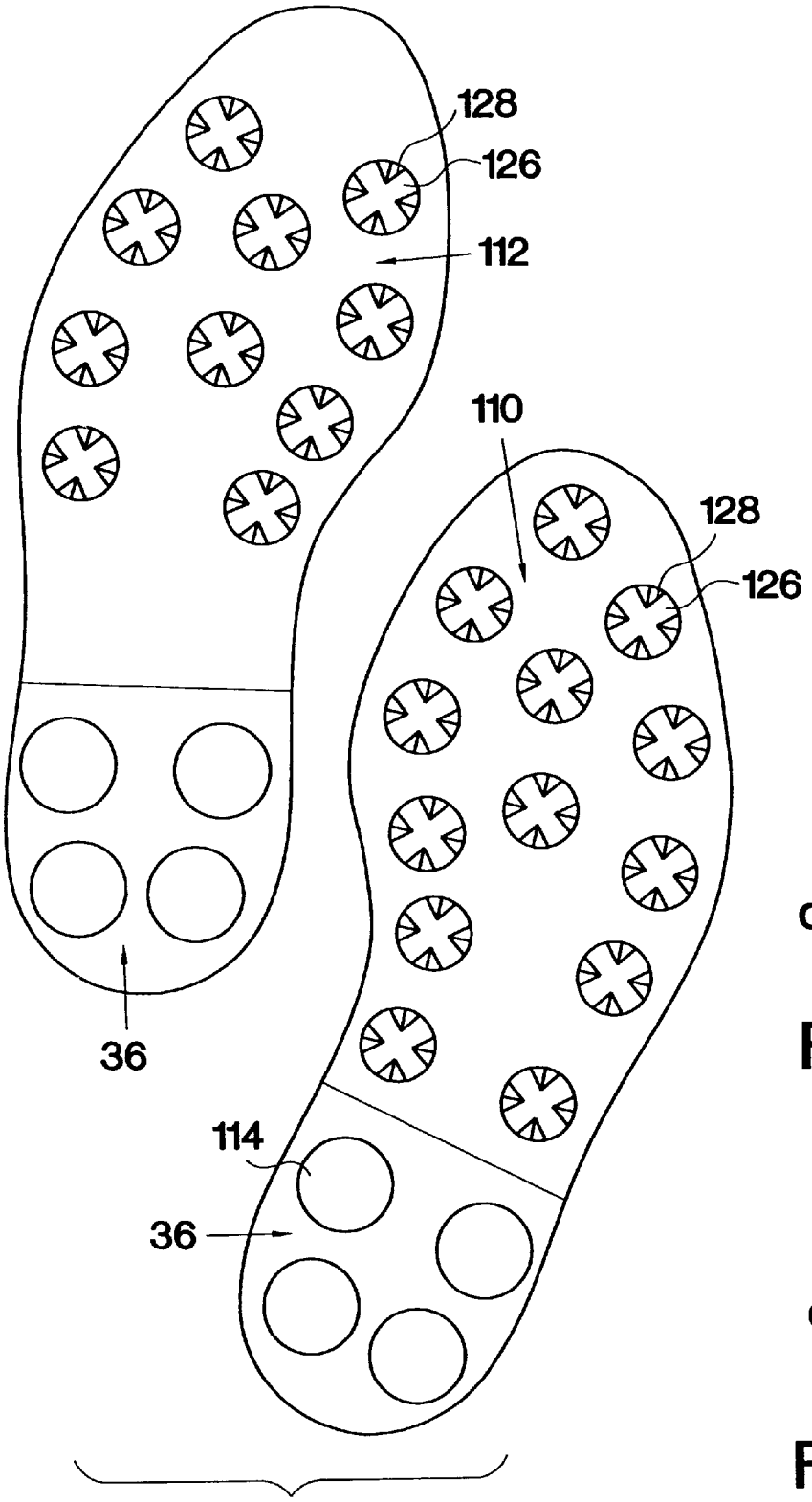
FIG. 13 is a second embodiment of a shoe incorporating different diameter replaceable spikes.
Figure 13A:
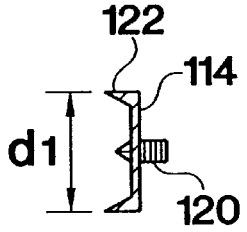
FIG. 13A is a cross-section of a first spike shown in FIG. 13.
Figure 13B:
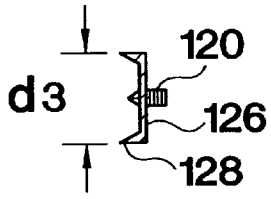
FIG. 13B is a cross-section of a third spike shown in FIG. 13.

The preferred embodiment of the golf shoe also includes a plurality of spike sockets for receiving a plurality of golf spikes 40*a*–40*q*. In the preferred embodiment, there are at least 14 spike sockets and, more preferably, there are 17 spike sockets. In the most preferred embodiment, there are approximately three spike sockets in the toe section 30, six spike sockets in the metatarsal section 32, four spike sockets in the shank section 34 and four spike sockets in the heel section 36. In the first embodiment, the front shoe (left shoe for a right handed player) and the back shoe (right shoe for a right handed player) are mirror images as far as spike socket locations, so that the shoes can be customized for right and left handed players. Alternatively, the back shoe can incorporate seventeen spike socket locations as shown in FIG. 2 and the front shoe can have ten to fourteen spike socket locations as shown in FIGS. 12 and 13. More particularly, the front shoe can have zero to two spike socket locations in the toe section 30, six spike socket locations in the metatarsal section 32, zero to two spike socket locations in the shank section 34 and four spike socket locations in the heel section 36.

In FIGS. 2 and 3, a plurality of spikes 40*a*–40*q* are inserted into the spike sockets. As will be discussed in more detail below, the spikes size, shape, material and locations can be varied to provide optimum, customized spike performance.

Figure 4C:
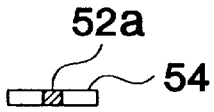
FIG. 4C is a section of the shoe spike socket frame shown in FIG. 4.
Figure 4D:
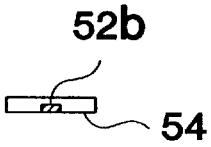
FIG. 4D is a section of the shoe spike socket frame shown in FIG. 4.
Figure 4B:
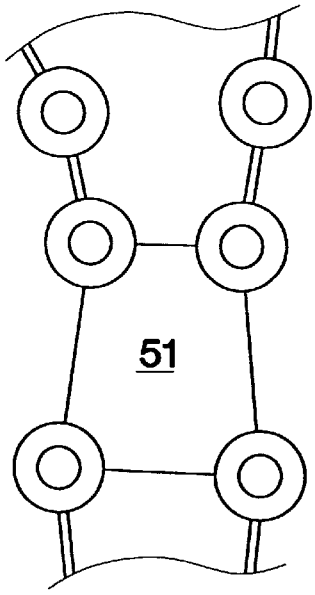
FIG. 4B is a section of a second embodiment of the shoe spike socket frame shown in FIG. 4.
Figure 4:
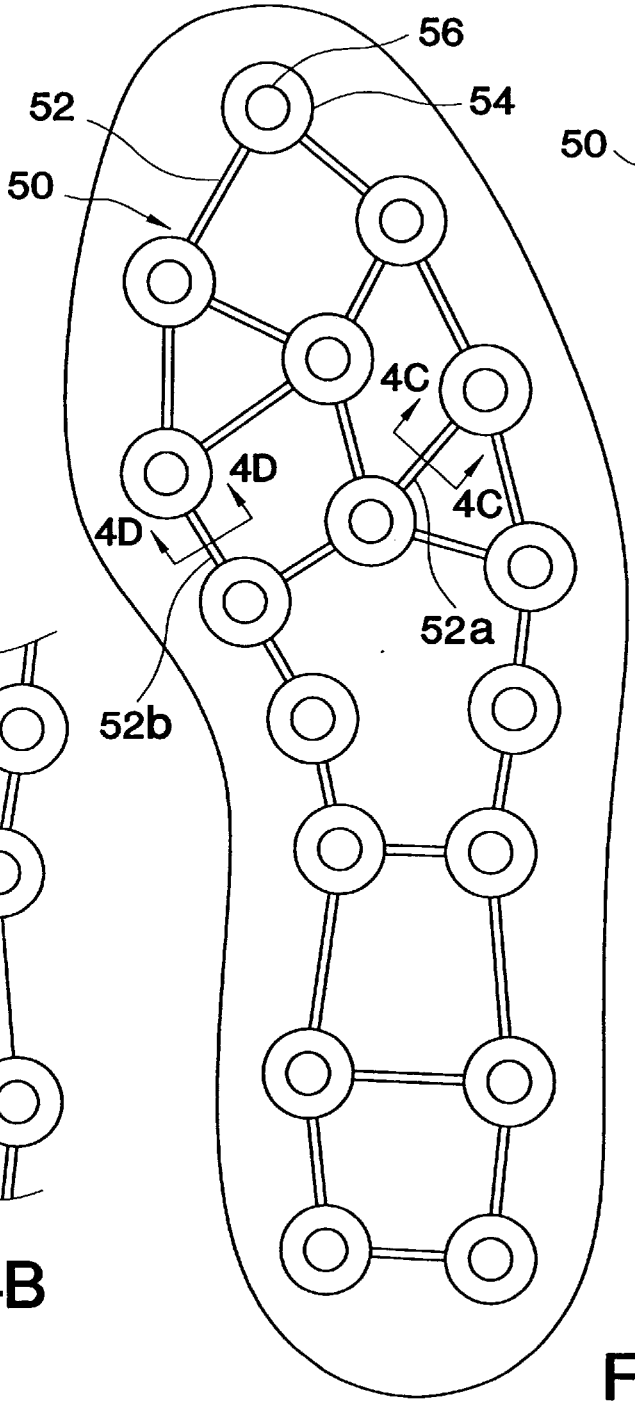
FIG. 4 is a molded shoe spike socket frame prior to incorporation into the cup sole.
Figure 5:
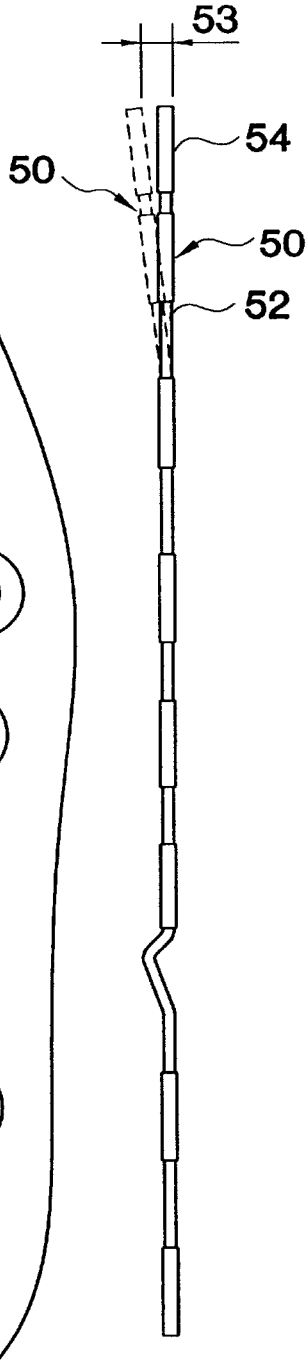
FIG. 5 is a side view of a molded shoe spike socket frame prior to incorporation into the cup sole.

Turning to FIGS. 4–5, the golf shoe includes a spike socket spine 50. The spine or frame 50 is comprised of a plurality of spike sockets or receptacles 54 and a plurality of ribs 52 interconnecting the spike sockets 54. Each of the plurality of spike sockets 54 is interconnected by the ribs 52. Thus, frame 50 is preferably comprised of a unitary integrally molded piece in which each socket 54 is connected to a rib 52. Frame 50 is preferably comprised of a polyurethane or TPU (thermoplastic polyurethane) which is harder than the material of cup sole (discussed below). More particularly, the frame 50 is comprised of a TPU incorporating carbon-graphite fibers or glass fibers. Preferably, the frame is comprised of a material, such as Isoplast 101 by Dow Chemical, incorporating up to 40% glass fibers and, most preferably, approximately 20% glass fibers. Preferably, the frame has a flexual modulus of approximately 1.5 Msi.

As shown in FIG. 4B, the frame 50 can further include a shank stiffening plate 51 that interconnects a plurality of the spike receptacles 54 that are located in the shank portion 34 with a plurality of spike receptacles in the heel section 36. The shank stiffening plate 51 is preferably integrally molded with the frame 50, but can be made separately from a different material, such as a carbon-graphite/epoxy composite, and added into the frame mold.

As shown in FIG. 4C and FIG. 4D the ribs 52 can be comprised of different cross-sectional areas to provide variable stiffness. More particularly, the ribs 52*a* that extend across the shoe frame 50 have a greater cross-sectional area than the ribs 52*b* that extend in the lengthwise direction of the frame 50. Thus, the frame 50 can provide greater crosswise stiffness than lengthwise stiffness.

As shown in FIG. 5, the frame 50 is preferably constructed such that the sockets 54 are approximately planar, i.e., a plane can be formed through all of the spike sockets. Alternatively, the frame 50' is shown in phantom with a slight arch such that the toe section 32 of the shoe is slightly raised a distance 53 from a planar surface such as the ground when the shoe is relaxed (no force is on the toe section from a foot). This enables the shoe to provide a stable, flat support for the golfer and allows all of the spikes to extend perpendicularly from the shoe into the ground.

Figure 6:
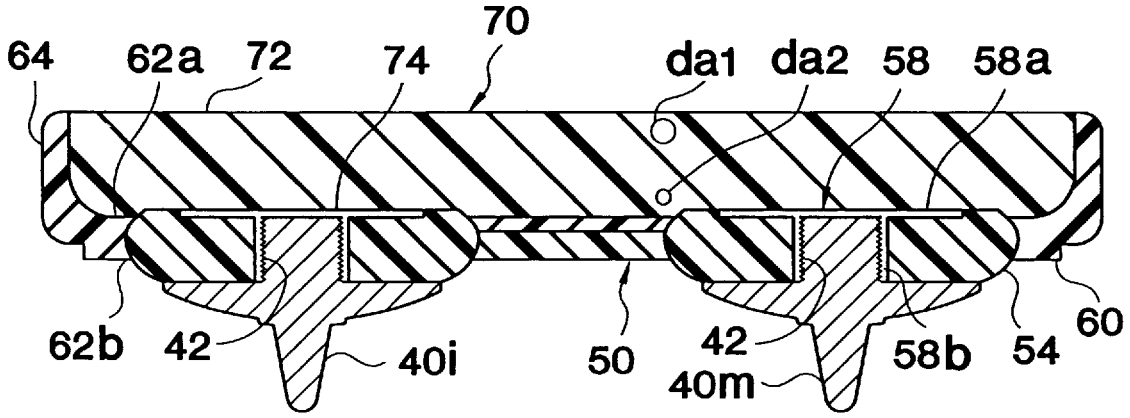
FIG. 6 is a first sectional view along line 6—6 of FIG. 2.

FIG. 6 discloses a first embodiment of the cup sole 60. The cup sole 60 is a shoe construction molded portion including outsole 60 having inside surface 62*a* and ground-engaging surface 62*b*, vertical side walls 64. Cup sole 60 is made of a TPU or TPU/TPR blend (thermoplastic polyurethane/thermoplastic rubber) that is softer than the frame 50. In other words, the cup sole 60 has greater flexibility than the frame 50 and a lower flexual modulus. Preferably, the cup sole 60 has a flexual modulus of approximately 10,000 to 30,000 psi. Thus, the frame 50 is approximately 50 to 150 times more rigid than the cup sole 60, so that the cup sole 60 provides a flexible material and the frame 50 provides structural stability. Preferably, the cup sole 60 is made from Dow Chemical's Pellethane polyurethane elastomer grade 2102, which has a shore A hardness of 85. To reduce cost, the cup sole 60 could be also be formed of a compression molded EVA.

The combination of cup sole 60 and frame 50 provides improved lengthwise flexibility, a spike socket which is close to the ground, a low weight sole, good crosswise stability, abrasion resistance, and cushioning to the wearer.

In a first embodiment of the invention, the cup sole 60 is filled to the top of side walls 64 with a midsole 70, which is comprised of a TPU/TPR blend, a foamed butadiene style rubber or a hytrel/surlyn blend. The midsole 70 is comprised of a material that is softer than the cup sole 60. Preferably, the midsole material has a Shore C hardness of approximately 30 to 60 and is foamed to provide a material that is light weight and has good cushioning for the wearer. Most preferably, the midsole 70 has a Shore C hardness of approximately 45. The midsole 70 can-be foamed with a blowing agent or, more preferably, with expanded resilient microspheres. In the most preferred embodiment, the midsole 70 is formed with expanded resilient microspheres such that the average diameter of the microspheres increases from the bottom surface 72 to the top surface 74 (described in more detail below). Thus, the first average diameter da1 of the expanded microspheres toward the top of the midsole 70 will be greater than the second average diameter da2 of the expanded microspheres toward the bottom of the midsole 70.

Furthermore, the midsole material can be formed under side pressure, such that the expanded microspheres are eliptical in shape with the greater axis being vertical. This allows the shoe to provide cushioning in the vertical direction and stability in the horizontal direction. In otherwords, the midsole has anisotropic properties.

In the first embodiment, the shoe is designed for standard shoe spikes 40 with threaded posts 42. Thus, the shoe incorporates metal spike inserts 58 with a plate section 58*a* and a threaded section 58*b* for engaging with the spike posts 42. However, it is contemplated that the shoe sole 14 can be constructed without the metal spike receiving inserts 58 and that threads or other engagement means can be provided directly in the spike receptacles 54.

In the first embodiment described, the shoe upper 12 is comprised of the inner and outer layers 22 and 20 which are attached to a canvas or other lasting board in a conventional manner. The upper 12 is then cemented to the midsole 70 to form the shoe 10.

Figure 7:
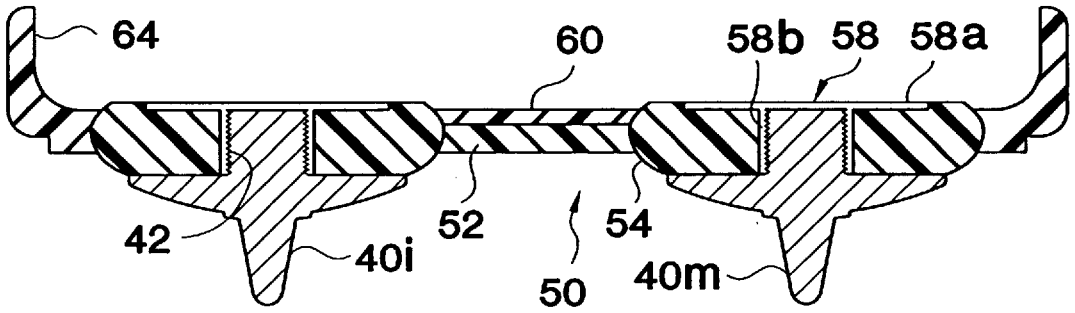
FIG. 7 is a second sectional view along line 6—6 of FIG. 2.
Figure 8:
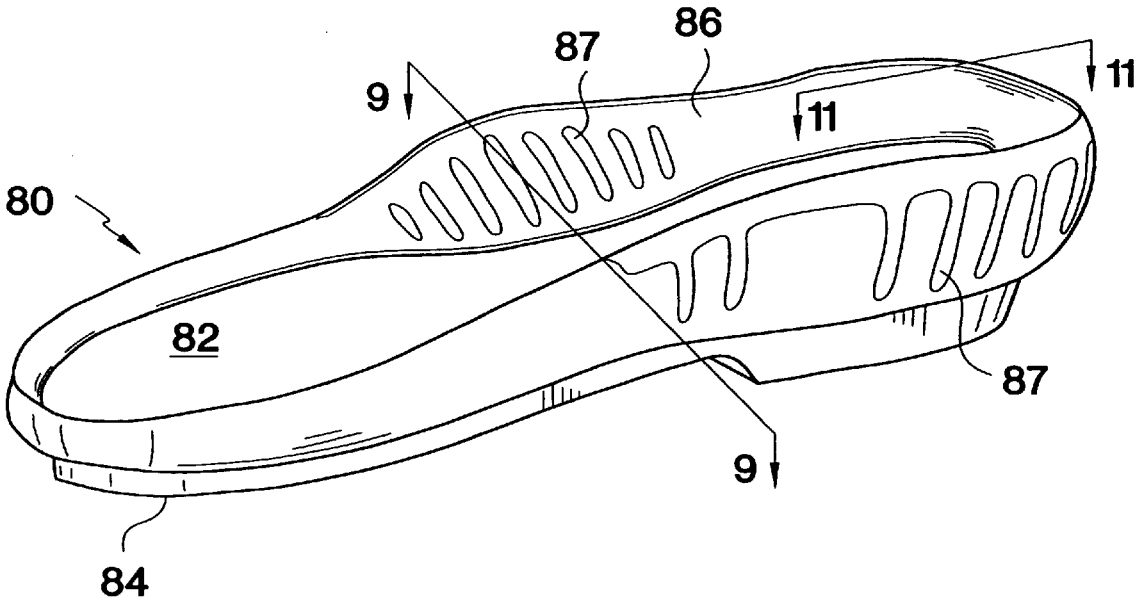
FIG. 8 is a perspective view of the foot bed.

FIG. 7 discloses a cross-section of a second embodiment of the cup sole 60. In this embodiment, there is no midsole and the shoe upper 12 is California lasted and then attached to the cup sole 60.

In the second embodiment of the present invention, the shoe sole can be formed without a midsole such that a foot bed 80 may be placed directly above the lasting board of the shoe upper and nearly adjacent to the socket frame 50 and cup sole 60 to provide greater shoe stability. The foot bed 80 is preferably comprised of a foamed upper layer 82, side walls 86 extending approximately perpendicularly from the upper layer and a waffle bottom layer 84 integral with the upper layer 82.

The foamed upper layer 82 can be comprised of a polyurethane foamed with hollow microspheres or a blowing agent. In another embodiment, the foamed layer can be a memory foam, i.e., a foam that deforms upon compression and once the pressure is released, will slowly return to its original position, comprised of a polyol, antifoam agent, catalyst and Isocyanate. Still further, the memory foam can be formed from approximately 58% Arcol LG-168, approximately 1% water, approximately 0.5% Dabco 131, approximately 0.5% Dabco 33LV and approximately 40% Isocyanate 2143L. The upper layer 82 preferably has a Shore C hardness of approximately 25.

The side walls 86 can be comprised of the same foam material as the upper layer 82, but can further include pockets 87 of polyurethane gel to provide a highly flowable viscoelastic medium. The polyurethane gel can be provided in various hardnesses to provide proper mediums for shoe comfort, including fit and cushioning. The polyurethane gel is preferably a soft elastomer with high sol (plasticizer) fraction which can include a high molecular weight triol (MW greater than 6000) and a diisocyanate. The polyol can be made of Arcol E-452 and the plasticizer can be a Paraffin oil or dipropylene glycol dibenzoate.

In another embodiment of the present invention, the flowable viscoelastic gel is a butadiene style rubber which can be prepared from oil and polyisobutadiene. Preferably, oil such as Kaydol and a styrene ethylene butadiene styrene triblopk medium molecular weight rubber polymer such as Kraton 1650 M. Kaydol is a paraffin (55%) and naphthenic (45%). By increasing the percentage of Kraton, the firmness of the gel can be increased for various locations where a firmer gel is desired. Still further, plastic, expanded, resilient, hollow microspheres such as Expancel 091 DE80, expanded glass hollow microspheres or a blowing agent can be added to the gel to reduce weight or the gel can be frothed with air using ultrasonic cavitation.

Figure 9:
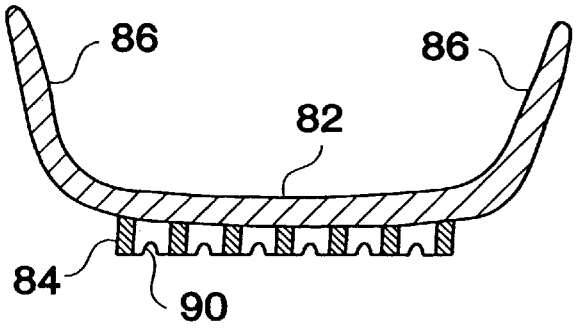
FIG. 9 is a sectional view along line 9—9 of FIG. 8.
Figure 10:
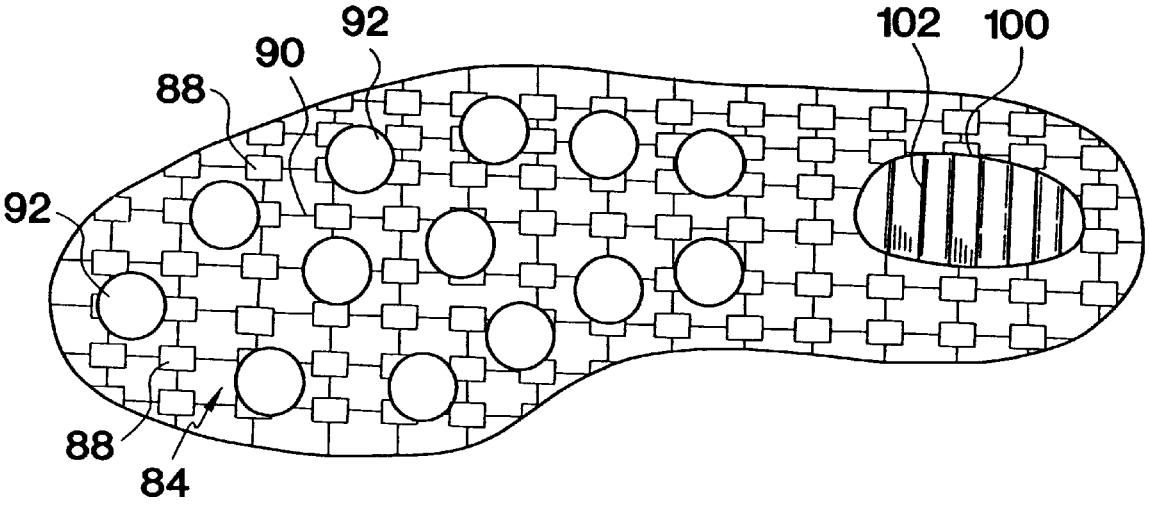
FIG. 10 is a bottom view of the foot bed.
Figure 11:
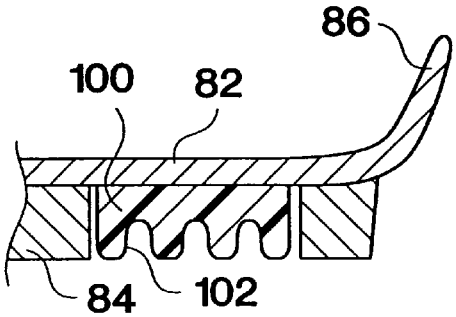
FIG. 11 is a sectional view along line 11—11 of FIG. 8.

Referring to FIGS. 9–11, the bottom layer 84 is comprised of a foam material formed into a waffle pattern with interconnecting bores or channels 90 for fluid communication between waffle openings 88. Preferably, bottom layer 84 can have openings 88 of any shape, such as square, round, etc., and should be made of a material that is harder than the upper layer 82. Preferably, the waffle bottom layer 84 has a Shore C hardness between 30–60 and, most preferably, about 50.

The bottom layer 84 preferably includes a plurality of soft viscoelastic gel plugs 92. These plugs 92 cover the spike sockets 54 in the toe, metatarsal and shank areas so that the spike pressure is dissipated from the wearer. The viscoelastic gel plugs 92 are preferably made of the same viscoelastic materials as described above, and have a –00 hardness of approximately 40–50.

Furthermore, the foot bed 80 preferably includes a heel plug 100 with compressible ribs 102 that form air pockets therebetween such that air can be pressed throughout the shoe foot bed 80. More particularly, the heel plug 100 has a plurality of ribs 102 extending to the outsole to create air pockets therebetween. When the golfer puts weight on the heel section, such as when walking, the ribs 102 will compress to provide cushioning and the air therebetween will be pumped through the waffle bottom layer 84 for air circulation throughout the shoe. The upper layer 82 can also have a waffle pattern or other perforations to provide air passage to the wearer's foot. Also, the shoe upper 12 can include a cordura window (not shown) to provide an air vent to the atmosphere. Preferably, the heel plug is also made of a viscoelastic material, such as those described above. However, the heel plug should be harder than the foot bed top layer 82, but softer than the foot bed bottom layer 84. More particularly, the heel plug should have a –00 hardness of approximately 40–50.

Referring back to FIG. 6 spike unit 40 with disk 44 and spike 46 is shown threaded into socket 58. Spike units 40 may be fully threaded, bayonet type or other engagement means. The present invention with its large number of sockets contemplate the use of a variety of spikes for each shoe including metal spikes, plastic spikes and spikes of other construction including threaded spikes, bayonet type or other engagement-means spikes. Further, the spike sockets may vary in size to accommodate such spikes. Finally, blank spikes may be positioned in sockets where traction at that position of the sole is not appropriate. For example, a left-handed golfer may require a different spike arrangement than a right-handed golfer and a high handicap golfer may require a more stable arrangement than a tour pro.

Further the present invention is directed to improved spike locations and to the customization of the golf spikes for the individual golfer. More particularly, the shoes according to the present invention have greater than fifteen spike socket locations. This provides increased stability for the golfers back foot and allows the shoe to be sold with a plurality of blank spikes in the front foot for increased mobility during the downswing.

Referring to FIGS. 12–13, the shoe can be used with an improved spike system comprised of replaceable spikes that have a plurality of diameters. The different diametered spikes provide for different amounts of stability and mobility for the golfer. This allows the golfer to customize the shoe for the preferred stability.

Referring to FIG. 12, back shoe 110 has seventeen spike socket location and front shoe 112 has fourteen spike socket locations. Each shoe incorporates a plurality of first spikes 114 having a first, large diameter d1 and a plurality of second spikes 116 having a second, small diameter d2. Each of the first and second spikes are replaceable, i.e., they have means for engagement 120 with the shoe receptacles and can be removed. As discussed above, the front shoe 112 can also be comprised of seventeen spike receptacles and blank spikes 118 (shown in phantom) can be used. Preferably, both the front and back shoe 112 and 110 incorporate first, large spikes 114 in the heel section 36 of the shoe. These spikes preferably have a diameter of approximately 20 mm and a plurality of protrusions 122. As shown, the spikes 114 have four pyramid shaped protrusions 122 located about the outer diameter of the spike. Preferably, both the front and back shoe 112 and 110 incorporate second, small spikes 116 in the shoe. These spikes 116 preferably have a diameter of approximately 10 mm and a plurality of protrusions 124. As shown, the spikes 116 have four pyramid shaped protrusions 124 located about the outer diameter of the spike. Alternatively, the second spikes 116 can be constructed with the same diameter as the first spikes, but the protrusions 124 could extend from the spike such that the outer diameter of the protrusions 124 is approximately 10 mm.

FIG. 13, discloses a second, more stable embodiment where back shoe 110 has seventeen spike socket location and front shoe 112 has fourteen spike socket locations. Each shoe incorporates a plurality of first spikes 114 having a first, large diameter d1 and a plurality of third spikes 126 having a third, medium diameter d3. Each of the first and third spikes are replaceable, i.e., they have means for engagement 120 with the shoe receptacles and can be removed. Preferably, both the. front and back shoe 112 and 110 incorporate first, large spikes 114 in the heel section 36 of the shoe. Preferably, both the front and back shoe 112 and 110 incorporate third, medium spikes 126 in the shoe. These spikes 126 preferably have a diameter of approximately 15 mm and a plurality of protrusions 128. As shown, the spikes 126 have four pyramid shaped protrusions 128 located about the outer diameter of the spike. Alternatively, the third spikes 126 can be constructed with the same diameter as the first spikes, but the protrusions 128 could extend from the spike such that the outer diameter of the protrusions 128 is approximately 15 mm.

With the present spike system, the golfer can mix and match the first, second and third spikes 114, 116 and 126 to customize shoe stability.

Figure 14:
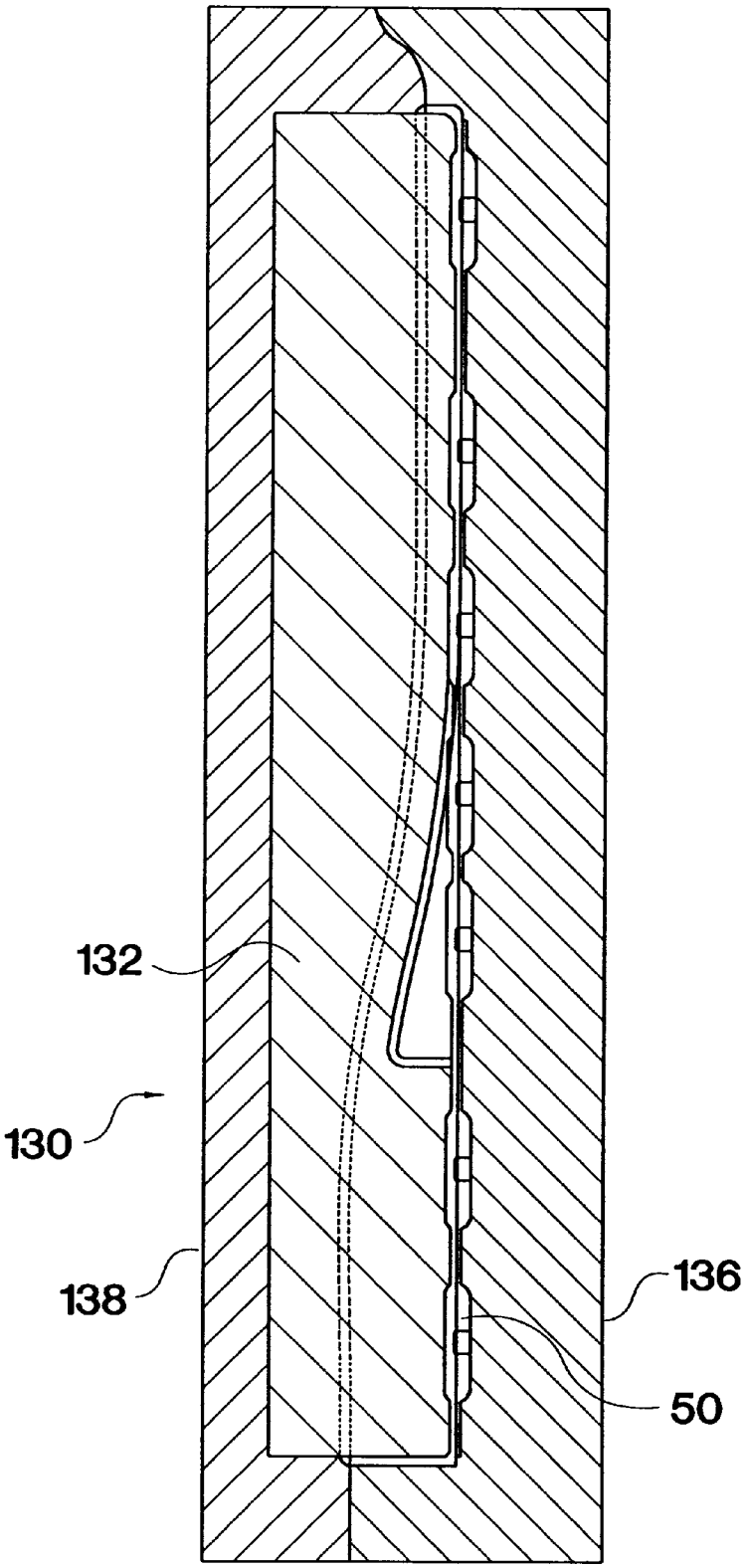
FIG. 14 is a sectional view of a mold for forming the cup sole mold with a fixed top plate.
Figure 15:
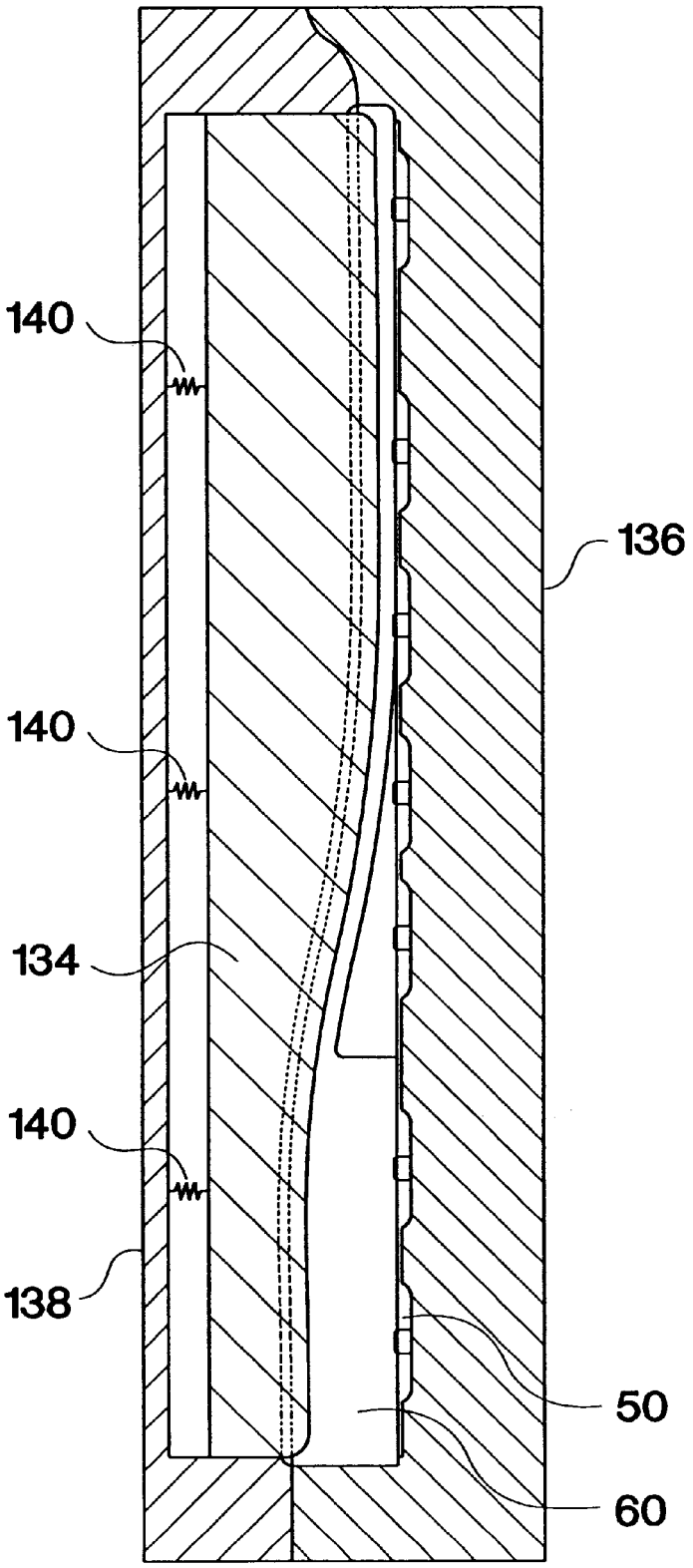
FIG. 15 is a sectional view of the mold in FIG. 15 for forming the midsole with a spring loaded top plate.

Referring to FIGS. 14 and 15, the present invention is also direct to an improved method of forming a shoe. The method comprises the steps of injection molding a shoe spine for receiving spike posts in a first mold, placing the spine into a second mold 130 and injection molding a cup sole about the spine with a fixed top plate 132, injection molding a midsole in the second mold 130 with a spring loaded top plate 134, and securing a shoe upper 12 to the midsole 70.

The second mold 130 includes a bottom 136 and a top 138. The top plate 132 is fixed between the bottom 136 and top 138 with the spike socket frame 50. The cup sole material is injected into the mold 130 to form the cup sole. After the cup sole is formed, a second, spring loaded top plate 134 is used to form the midsole. The second top plate 134 is spring loaded with a plurality of springs 140 so that the midsole material can be injected into the mold and heated. As the microspheres therein expand, the spring loaded top plate 134 can displace to allow for the expansion. By applying heat to the top plate 134 only, the microspheres on the top of the mild will be heater more than the microspheres on the bottom of the mold. In this manner, the average diameter of the expanded microspheres on the top of the midsole can be made larger than the average diameter of the expanded microspheres on the bottom of the midsole. Furthermore, by applying pressure during the heating of the midsole material, the microspheres can be formed in elliptical shape. By applying side pressure, the ellipses can be formed such that the greater axis in the vertical direction to provide vertical cushioning and the material will be stable in the horizontal direction.

The present invention is also direct to a second improved method of forming a shoe. The method comprises the steps of injection molding a shoe spine for receiving spike posts in a first mold, placing the spine into a second mold and injection molding a cup sole about the spine with a fixed top plate, securing a shoe upper having a California last to the cup sole and inserting a foot bed into the shoe upper.

While it is apparent that the illustrative embodiments of the invention herein disclosed includes many advantages over the prior art, it will be appreciated that numerous modifications and other embodiments may be devised by those skilled in the art. Therefore, it will be understood that the appended claims are intended to cover all such modifications and embodiments which come within the spirit and scope of the present invention.

We claim:

1. A shoe sole comprising:

(a) a cupsole for having contact with the ground; and (b) a midsole coupled to the cupsole and being softer than the cupsole, the midsole comprising a first material of a blend of a thermoplastic polyurethane, a thermoplastic rubber and expanded resilient microspheres to reduce weight and provide cushioning.

2. The shoe sole of claim 1, wherein the thermoplastic rubber is present in an amount sufficient to impart a hardness of about 30 to 60 Shore C.

3. The shoe sole of claim 2, wherein the thermoplastic rubber is present in an amount sufficient to impart a hardness of about 45 Shore C.

4. The shoe sole of claim 2, wherein the cupsole is a composite of a cupsole material and a frame material that is stiffer than the cupsole material.

5. The shoe sole of claim 4, wherein the frame material is comprised of a thermoplastic urethane and a sufficient amount of reinforcement fibers to increase material hardness.

6. The shoe sole of claim 4, wherein the frame material forms a frame that is integral with the cupsole material to increase stiffness of the cupsole.

7. The shoe sole of claim 6, wherein the frame is configured to provide greater stiffness in a crosswise direction extending across a width direction of the sole than in a longitudinal direction extending along a lengthwise direction of the sole.

8. The shoe sole of claim 7 wherein the frame includes a plurality of spike sockets in heel, metatarsal and toe sections.

9. The shoe sole of claim 1, wherein the cupsole comprises a blend of thermoplastic urethane and thermoplastic rubber, wherein the thermoplastic polyurethane represents greater than 50% by weight of the blend.

10. The shoe sole of claim 9, wherein the cupsole has a flexural modulus of approximately 10,000 to 30,000 psi.

11. The shoe sole of claim 10, wherein the midsole has a first region wherein the expanded resilient microspheres have a first average diameter and the midsole has a second region wherein the expanded resilient microspheres have a second average diameter that is less than the first average diameter.

12. The shoe sole of claim 11, wherein the first region comprises a top portion of the shoe midsole to provide soft cushioning for a wearer's foot and the second region comprises a bottom portion of the shoe midsole.

13. A shoe sole comprising: a midsole comprising a blend of a thermoplastic polyurethane, a thermoplastic rubber in an amount sufficient to impart a hardness of about 30 to 60 Shore C, and expanded resilient microspheres in an amount sufficient to provide cushioning and to reduce the weight.

* * * * *